US006848979B2

(12) United States Patent
Fennessy

(10) Patent No.: US 6,848,979 B2
(45) Date of Patent: Feb. 1, 2005

(54) CONCRETE BLASTING DEVICE WITH CLEAR WAND, STIFF BRUSH, RECOVERY CYLINDER, AND RECIRCULATING CYLINDER

(76) Inventor: Paul Michael Fennessy, 17 Blackwood Dr., Liverpool, NY (US) 13090

( * ) Notice: Subject to any disclaimer, the term of this patent is extended or adjusted under 35 U.S.C. 154(b) by 144 days.

(21) Appl. No.: 10/051,807

(22) Filed: Dec. 7, 2001

(65) Prior Publication Data

US 2002/0072304 A1 Jun. 13, 2002

Related U.S. Application Data

(60) Provisional application No. 60/254,198, filed on Dec. 11, 2000.

(51) Int. Cl.[7] ..... B24C 9/00; B24C 5/04

(52) U.S. Cl. ..... 451/87; 451/88; 451/100; 451/102

(58) Field of Search ..... 451/38–40, 29, 451/75, 87, 88, 90, 99, 100, 101, 102

(56) References Cited

U.S. PATENT DOCUMENTS 2,643,456 A * 6/1953 Maurer et al. ..... 433/88
2,752,732 A 7/1956 Walker
4,212,138 A * 7/1980 Hutchison ..... 451/90
4,395,850 A * 8/1983 Brown ..... 451/102
4,646,480 A 3/1987 Williams
4,646,482 A 3/1987 Chitjian
4,984,397 A 1/1991 Van Leeuwen
5,207,234 A 5/1993 Rosso
5,334,019 A * 8/1994 Goldsmith et al. ..... 433/88
5,489,234 A 2/1996 Hockett
5,716,260 A 2/1998 Griffin et al.
5,800,246 A 9/1998 Tomioka
5,839,951 A 11/1998 Tomioka

* cited by examiner

*Primary Examiner*—Hadi Shakeri
(74) *Attorney, Agent, or Firm*—Shlesinger, Arkwright & Garvey LLP

(57) ABSTRACT

Blasting device includes a blasting medium supply unit and a blasting gun. An extension is provided on the blasting gun, which extension may include a sufficiently clear portion so that the user of the blasting gun may view the surface which is being blasted.

10 Claims, 2 Drawing Sheets

FIG.2
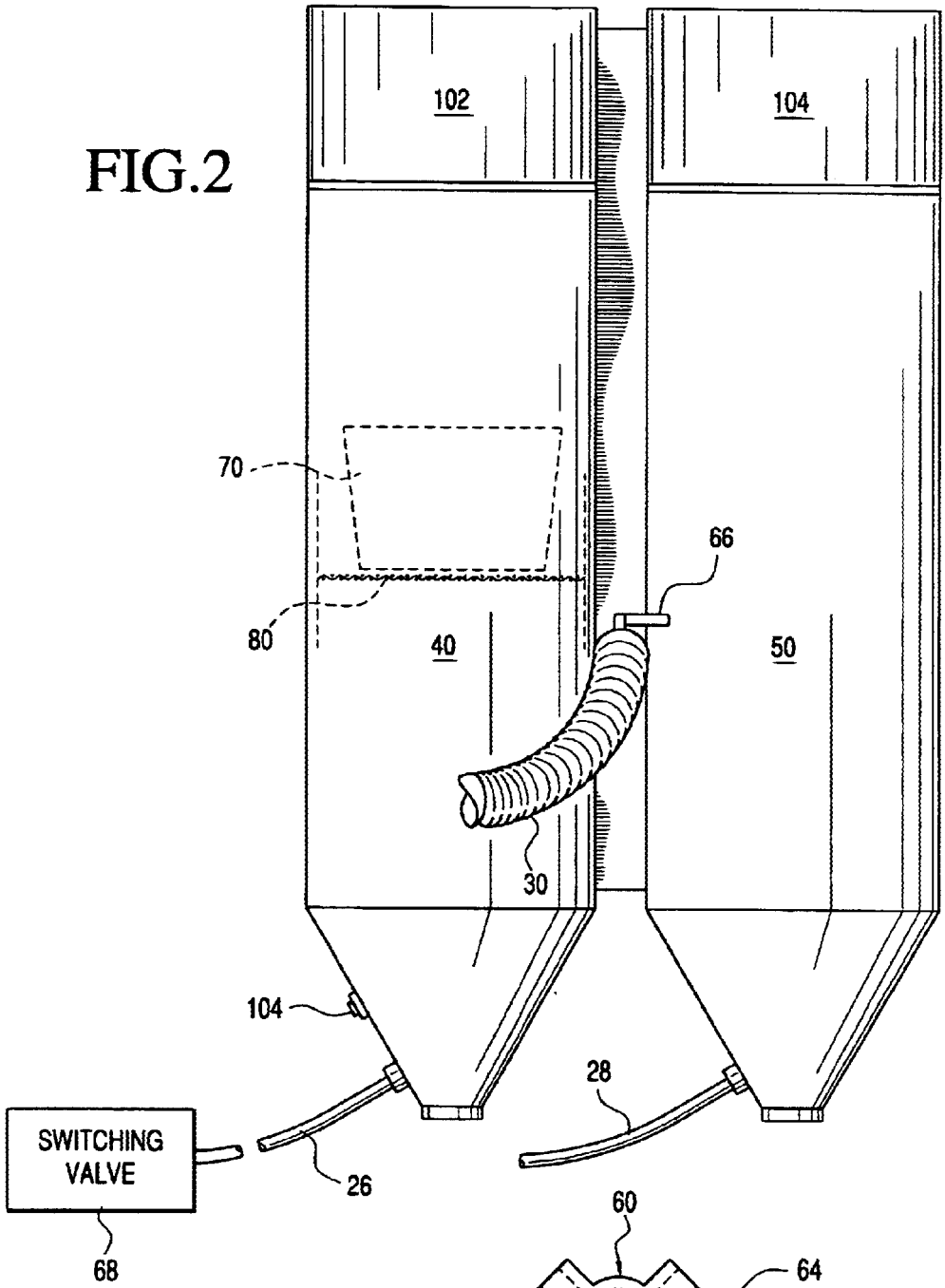
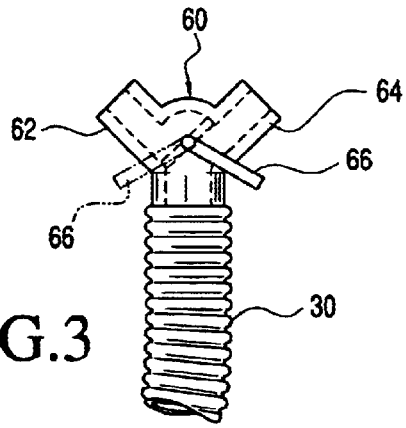
FIG.3

CONCRETE BLASTING DEVICE WITH CLEAR WAND, STIFF BRUSH, RECOVERY CYLINDER, AND RECIRCULATING CYLINDER

CROSS REFERENCE TO RELATED APPLICATIONS

This application claims the priority benefit of Provisional Application No. 60/254,198, filed Dec. 11, 2000, which is incorporated herein by reference.

This application relates to application Ser. No. 09/563,887, filed May 3, 2000, which claims the priority of application Ser. No. 60/132,166, filed May 3, 1999, and both of which are incorporated herein by reference.

BACKGROUND OF THE INVENTION

The invention relates to fluid powered blasting equipment. More particular, the invention relates to gas powered blasting equipment. Still more particularly, the invention relates to pneumatic blasting guns that are suitable for blasting with a variety of blasting media.

FIELD OF THE INVENTION

Blasting equipment is known, such as a typical sandblasting machine that is used for abrasive removal of paint from an underlying substrate, such as a brick wall; blasting equipment for stress relief of metal workpieces; and blasting equipment for removing portion of substrates, such as bricks, so as to yield recessed numbers, letters, and designs, for examples.

Examples of known blasting equipment include the following United States Patents:

U.S. Pat. No. 2,752,732 to Walker
U.S. Pat. No. 5,207,234 to Rosso
U.S. Pat. No. 5,489,234 to Hockett
U.S. Pat. No. 5,716,260 to Griffin et al.
U.S. Pat. No. 4,646,480 to Williams
U.S. Pat. No. 4,646,482 to Chitjian
U.S. Pat. No. 4,984,397 to Van Leeuwen
U.S. Pat. No. 5,800,246 to Tomioka
U.S. Pat. No. 5,839,951 to Tomioka
All of the above devices have various drawbacks.

OBJECTS AND SUMMARY OF THE INVENTION

It is an object of the invention to provide a blasting device that overcomes the drawbacks of the prior art.

Another object of the invention is to provide a blasting device that has a double recirculating cylinder, so that at least two (2) types of blasting media may be used, and so that the user may readily switch from one type of blasting media to the other.

Yet another object of the invention is to provide a blasting device that allows the user to observe the area which is being blasted by the blasting medium, in use.

Abrasive blasting device includes a double cylinder, such as a one piece unit molded in polyethylene.

One cylinder of the double cylinder may serve as a recirculating cylinder for use when reusable blasting medium is used, for example.

The other cylinder of the double cylinder may be a recovery cylinder for use when single-use blasting media is used such as BLACK BEAUTY™ blasting medium, for example.

The invention may include an electric motor for each one of the two cylinders. For example, a two horsepower motor may be provided for each cylinder so that readily available 110 volt AC electrical outlets can be used. Alternatively, one may use a single motor to drive the respective fans for each of the two cylinders.

The blasting device may likewise include a switching valve having a handle and an angled split divider so that the user may readily switch between one blasting media and the other.

Furthermore, the invention may include a 4 inch flexible recovery brush, including 70–80 durometer rubber bristles 1½ inches long and a clear cylinder provided between the flexible recovery brush and a blasting nozzle of a blasting gun.

The clear cylinder may be a polycarbonate (PC) pipe so that the user can see what is being "sand blasted". The shutoff plates in the valve typically may be at an angle so that the blasting media may be properly directed. The cylinder may be ¼ inch pipe.

A heavy-duty frame and wheels may be provided.

A wire rack for carrying a blasting media pail can be provided in the recirculating cylinder of the pair of cylinders.

Thus, the invention is suited not only for readily switching between one type of blasting media and the other, but is particularly suited for recovering reusable blasting media.

BRIEF DESCRIPTION OF THE DRAWINGS

FIG. 2 illustrates a double recovery cylinder suitable for recovering, alternately, two(2) different types of blasting media; and FIG. 3 illustrates a further switching valve by which the user may switch from one type of blasting media to another.

Figure 1:
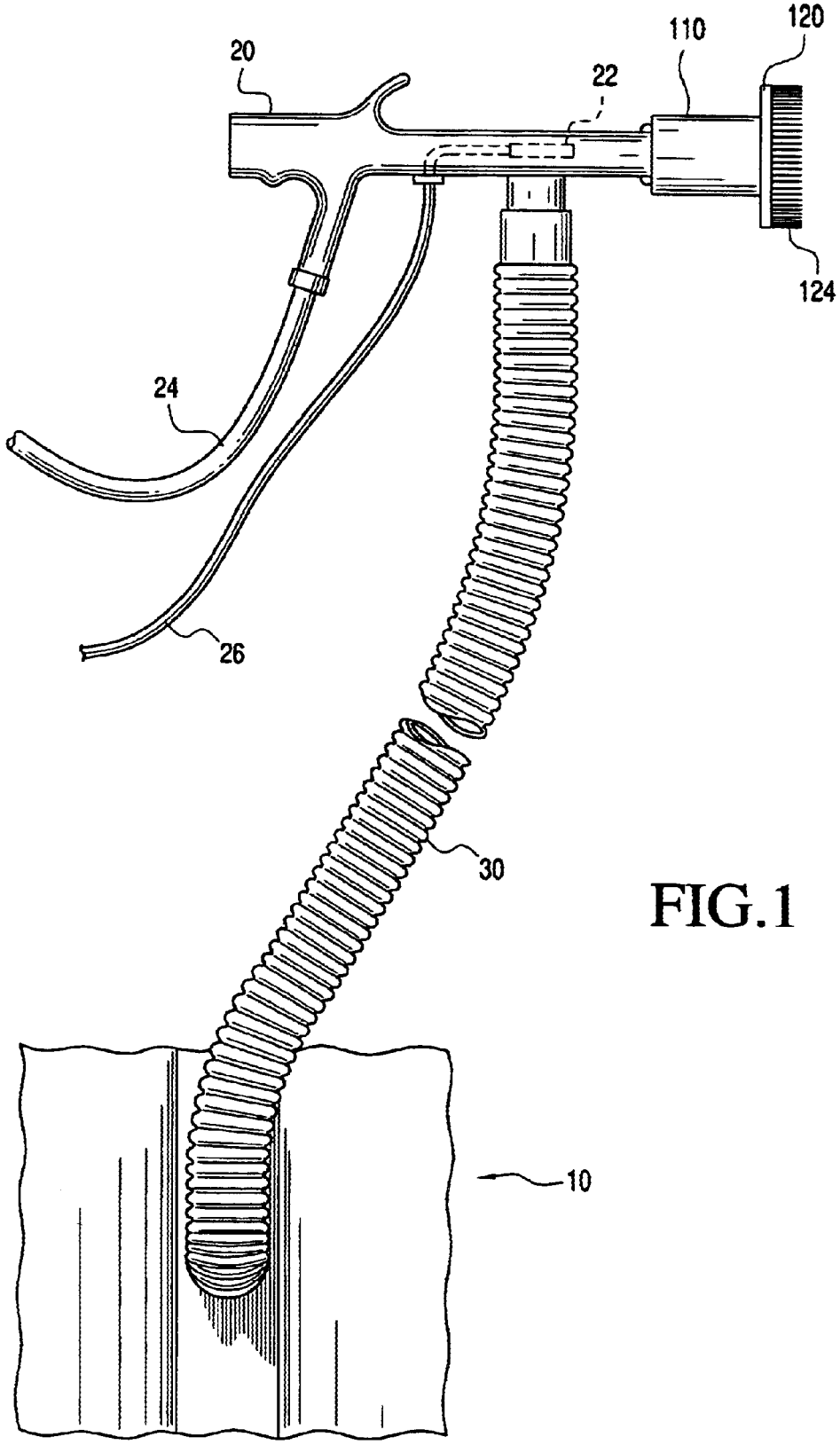
FIG. 1 illustrates a preferred embodiment of a blasting gun having a blasting nozzle through which the user may see the area being blasted.

It should be understood that relative terms such as up, down, left, and right are for convenience only and are not intended to be limiting.

DETAILED DESCRIPTION OF THE INVENTION

FIGS. 1–3 illustrate an embodiment of an abrasive blasting device 10, such as a concrete blasting device, according to the invention.

Blasting device 10 includes a blasting gun 20 including a blasting nozzle 22.

Blasting gun 20 is connected to a source of pressurized gas, such as an air compressor by an air compressor hose 24. Blasting gun 20 may include a blasting nozzle 22 sized to handle ½ inch to three ¾ inch width cutting surface.

Blasting media is supplied to blasting gun 20 through a media supply hose 26 or a blasting medium pick-up tube 28.

A recovery hose or vacuum hose 30 which may be flexible, fluidly connects blasting gun 20 to the remainder of blasting device 10, such as to a blasting medium recovery cylinder 40 or, alternately, to a blasting medium recovery cylinder 50.

Blasting medium recovery cylinders 40 and 50 may be made as a one piece molded unit, such as the illustrated double cylinder unit of FIG. 2. The cylinders 40 and 50 may be made of polyethylene, for example.

The unit may be configured for easy transportation, such as by being mounted on wheels; e.g., on a heavy-duty cart unit having balloon tires.

A switching valve 60 may be provided for switching between the desired one of blasting medium recovery cylinders 40 and 50, by switching between pipe 62 fluidly connected to cylinder 40 and pipe 64 fluidly connected to recovery cylinder 50, respectively.

A handle 66 for switching valve 60 to direct flow to pipe 40 and 50 may be provided.

A switching valve 68 may be provided for switching between the at least two blasting tanks 40, 50, for alternately supplying blasting medium from each of the two supply tanks 40, 50.

A blasting medium pail 70 may be provided on a wire rack 80 in one or both of blasting medium recovery cylinders 40 and 50.

A single electrical motor may be provided for power fan(s) for cylinders 40 and 50.

Alternatively, as illustrated, electric motors 102 and 104 may be provided for respective ones of blasting medium recovery/recirculating cylinders 40 and 50.

Electricity may be provided to electric motors 102 and 104 by a cord having dual switches for powering one motor or both motors concurrently. An air vent 104 may be provided in blasting medium recovery cylinder 40, for example.

In addition to or instead of a known bellows, an at least partially clear extension 110 may be provided with a window, a clear portion or may be made of a clear or clear/colorless piece of tube, such as a piece of cylindrical clear pipe, so that the user may view the area which is being blasted. Extension 110 may be made of a polycarbonate. Extension 110 may have a ¼ inch outer diameter (O.D.) And be 2 inches long, for example.

In addition, a flexible recovery brush 120 may be provided on the free end at least partially clear extension 110 to assist in the recovery of the blasting medium.

The flexible recovery brush may include relatively long bristles 124 that may be made of a material, such as 70–80 durometer rubber, bristles 124 having a length of about 1½ inches long, for example.

Other blasting media may be used such as steel grit (e.g., Amstel Co., Illinois), steel shot, or blasting media sand.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A blasting device, comprising:

a) a blasting medium supply unit;

b) the blasting medium supply unit including at least two(2) blasting medium supply tanks;

c) a blasting gun;

d) an extension provided on the blasting gun, the extension including a sufficiently clear portion so that a user may view a surface being blasted, in use;

e) a switching valve provided for switching between the at least two(2) blasting medium supply tanks, for alternately supplying blasting medium from each of the two(2) supply tanks;

f) a recovery hose provided for recovery blasting medium, in use; and g) a further switching valve being provided for directing recovered blasting medium to alternate ones of the at least two (2) blasting medium supply tanks.

2. A blasting device as in claim 1, wherein:

a) the sufficiently clear portion of the extension includes a substantially clear pipe.

3. A blasting device as in claim 2, wherein:

a) the substantially clear pipe is colorless.

4. A blasting device as in claim 1, wherein:

a) the blasting gun is substantially directly connected to the blasting medium supply unit.

5. A blasting device as in claim 1, wherein:

a) the sufficiently clear portion of the blasting gun includes a plastic portion.

6. A blasting device, comprising:

a) a blasting medium supply unit;

b) the blasting medium supply unit including at least two(2) blasting medium supply tanks;

c) a switching valve provided for switching between the at least two(2) blasting medium supply tanks, for alternately supplying blasting medium from each of the two(2) supply tanks;

d) a recovery hose provided for recovering blasting medium, in use;

e) a further switching valve is provided for directing recovery blasting medium to alternate ones of the at least two(2) blasting medium supply tanks;

f) a blasting gun fluidly connected by the recovery hose to the blasting medium supply unit; and g) an extension provided on the blasting gun, the extension including a sufficiently clear portion so that a user may view a surface being blasted, in use.

7. A blasting device as in claim 6, wherein:

a) the clear portion of the extension includes a substantially clear pipe.

8. A blasting device as in claim 7, wherein:

a) the substantially clear pipe is colorless.

9. A blasting device as in claim 7, wherein:

a) the clear pipe includes a plastic pipe.

10. A blasting device as in claim 6, wherein:

a) the clear portion includes a plastic.

* * * * *